US005346104A

United States Patent [19]

Jeong

[11] Patent Number: 5,346,104

[45] Date of Patent: Sep. 13, 1994

[54] DISCHARGING PATH OPEN/CLOSE SHIFTING VALVE FOR LIQUID STORING CONTAINER

[76] Inventor: Sang-Hyen Jeong, No. 481-61, Mang Yang-Ri, On Yang-Myun, Ul San-Kun, Kyung Nam, Rep. of Korea

[21] Appl. No.: 16,032

[22] Filed: Feb. 10, 1993

[30] Foreign Application Priority Data

Dec. 24, 1992 [KR] Rep. of Korea ..... 1992 - 25615
Jan. 27, 1993 [KR] Rep. of Korea ..... 1993 - 00988

[51] Int. Cl.[5] ..... B65D 83/00
[52] U.S. Cl. ..... 222/402.19; 137/38
[58] Field of Search ..... 222/402.1, 402.19, 402.18, 222/402.11; 137/38, 43

[56] References Cited

U.S. PATENT DOCUMENTS 3,545,488 12/1970 Venus ..... 222/402.19 X
4,277,001 7/1981 Nozawa ..... 222/402.19 X
4,454,964 6/1984 Sacher ..... 222/321
4,572,406 2/1986 Pratt et al. ..... 222/402.19
4,723,692 2/1988 Meuresch et al. ..... 222/402.19
4,775,079 10/1988 Grothoff ..... 222/402.19 X
4,978,038 12/1990 Sullivan ..... 222/402.19

FOREIGN PATENT DOCUMENTS 245734 10/1925 United Kingdom ..... 222/402.19

*Primary Examiner*—Andres Kashnikow
*Assistant Examiner*—Kenneth DeRosa
*Attorney, Agent, or Firm*—Ladas & Parry

[57] ABSTRACT

A discharge apparatus for liquid stored in a container has a storage tank with a discharging member at the top thereof. A discharging pipe extends between the inside of the container and the discharging structure. A discharging path open/closing shifting valve is provided and comprises first and second connecting pipes extending from the shifting valve to the upper and lower sides of the discharging apparatus. The valve is opened and closed by ascending and descending opening/closing balls. A plunger is provided and is movable between the open/closing balls for alternatively opening or closing the first and second connecting pipes respectively.

4 Claims, 5 Drawing Sheets

DISCHARGING PATH OPEN/CLOSE SHIFTING VALVE FOR LIQUID STORING CONTAINER

TECHNICAL FIELD OF THE INVENTION

The present invention relates to a contents discharging device for all kinds of liquid storing containers storing liquid contents within a cylindrical container and wherein the contents are either discharged by a compressed gas filled within the container or discharges through a separate tube by an external suction power. More particularly, the invention relates to a discharging path open/close shifting valve for a liquid storing container capable of easily discharging the contents in any direction without being disturbed by a change in the contents position, for example, the storing container either standing uprightly or inversely.

PRIOR ART

A liquid storing container which stores a liquid contents and discharges these contents through a separate discharging tube by means of compressed gas within the container, or by suction power, and which is relatively small, easy to transport, and easy to carry is widely utilized, and used in various fields of technology. For example, it is used in many cased for storing insecticide, deodorizer, aromatic and lubricant, as a coloring air sprayer and a sucking bottle for spreading powdered milk for babies.

These liquid storing containers generally have a receiving space in which the contents of liquid is hermetically stored. These storing containers usually are made in cylindrical or polygonal cubic form. An outlet is provided at the tope of this storing container whereby it may discharge the liquid contents stored therein. The outlet is made in various forms. For example, it has either a structure capable of spraying the contents in fine particle state, or it has a structure capable of spouting out the contents in the form of a water jet. A discharging tube may be provided within the storing container. This discharging tube is an indispensable component of the liquid storing container, and comprises a small tube having an inner diameter and located in close proximity to the bottom surface within the storing container. It is located in close proximity as far as possible so as to be able to discharge the content at the lowermost level by a compressed gas within the storage container, or by suction poser, so that the contents are expelled by compression action on the liquid surface of the stored material within the storage container where the storage container stands upright. Alternatively, it is sucked out by a suction power operating from the exterior of the storage container.

These fluid storage containers could be discharged without any problem when the storage container stands upright. Where the storage container is on its side or inverted, and the stored level of the contents within the storage container changes to that the free tip end of the discharging tube is away from the contents, there is a problem and the contents may not be discharged. Accordingly, it is inconvenient to use because it is necessary to stand upright the fluid storage container. Therefore, it has the disadvantage that not only is it unsuitable at times but the dispensing process is sluggish.

OBJECT AND SUMMARY OF THE INVENTION

Therefore, the present invention was made in considering the above situation, and it is an object of the present invention to provide a discharging path shifting valve for a simple and effective liquid storing container which has discharging paths at upper and lower sides and shifts the discharging paths of the contents in accordance with the position change of the contents level within the storage container so that the discharging of the contents is made possible without being affected by whether the storage container stands upright or inverted.

Another object of the present invention is to provide a discharging path shifting valve for a liquid storing container which is convenient in using and capable of improving utility and productivity.

These object of the present invention are attained by providing a liquid storing container which stores liquids and uses a separate discharging tube for providing a discharging path for the contents. The storing container has a storage tank for providing a suitable storing space. An outlet for discharging and simultaneously charging the contents is provided at the top of this storage tank. The outlet has a discharging structure for either discharging the contents in pulverized form or spouting out the contents in a water jet form. A discharging tube which is provided among the contents stored within the storage container and the discharging structure provides a discharging path for the contents. An open/close shifting valve is provided at the upper and lower sides with first and second introducing tubes which merge the contents. These are located at different positions at an end of the discharging tube. The open/close shifting valve has opening/closing balls which ascend and descend by a self-weighting effect in accordance with the position that the storage container is placed in. First or second introducing tubes alternatively and mutually open/close the first and second introducing pipes and thereby shift the direction of the discharging path of the contents. Accordingly, the contents may be easily discharge in any direction independently of whether the storage container stands upright or inverted.

DETAILED DESCRIPTION OF THE PREFERRED EMBODIMENT

Hereinafter, a preferred embodiment of the present invention will be described in more detail with reference to the accompany drawings.

Figure 1:
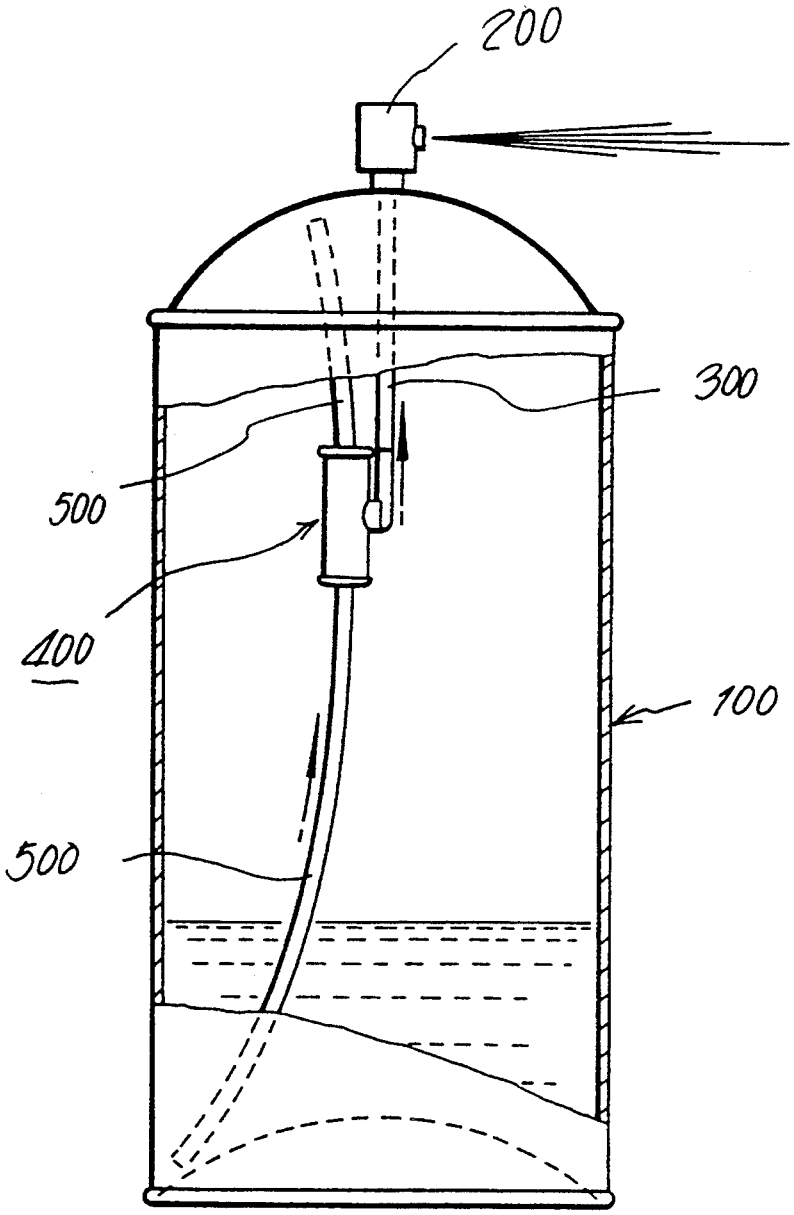
FIG. 1 is a longitudinal cross-sectional view showing a liquid storing container having a discharge path open/close shifting valve of the present invention.

FIG. 1 shows a liquid storing container provided with an open/close shifting valve in accordance with the present invention, and this storing container is an example of a container for storing an spreading the contents of liquids such as insecticides, aromatics and the like. This container is also an embodiment which utilizes the discharging path open/close shifting valve of the present invention, and the contents within the container will be expelled through the discharging tube by a compressed gas acting on an upper portion of stored liquid level of the contents. The present embodiment may also be used for a storage container other than above, i.e., a nursing container, a portable water container and the like for sucking out the contents within the storage container.

The storage container has a storage tank 100 for storing the contents in a liquid state. This storage tank 100 provides a receiving space for hermetically storing the contents in a small amount in a liquid state.

The storage tank 100 is substantially in a cylindrical form and provided with a discharging structure 200 for discharging the contents. The discharging structure 200 sprays the contents within the storage container in fine particle form.

The storage tank 100 is constructed using a thin metal plate material maintaining a strength capable of receiving the contents to be store to an appropriate level with a little pressure.

A discharging tube 300 is provided within the storage tank 100, and this discharging tube 300 is an indispensable component which provides a discharging path for discharging the contents within the storage container to the exterior. The tube 300 is generally constituted by a thin small tube of synthetic resin material and connected to the discharging structure 200 provided at the top portion of the storage tank. An open/close shifting valve 400 is provided at the end portion of this discharging tube 300.

Figure 2:
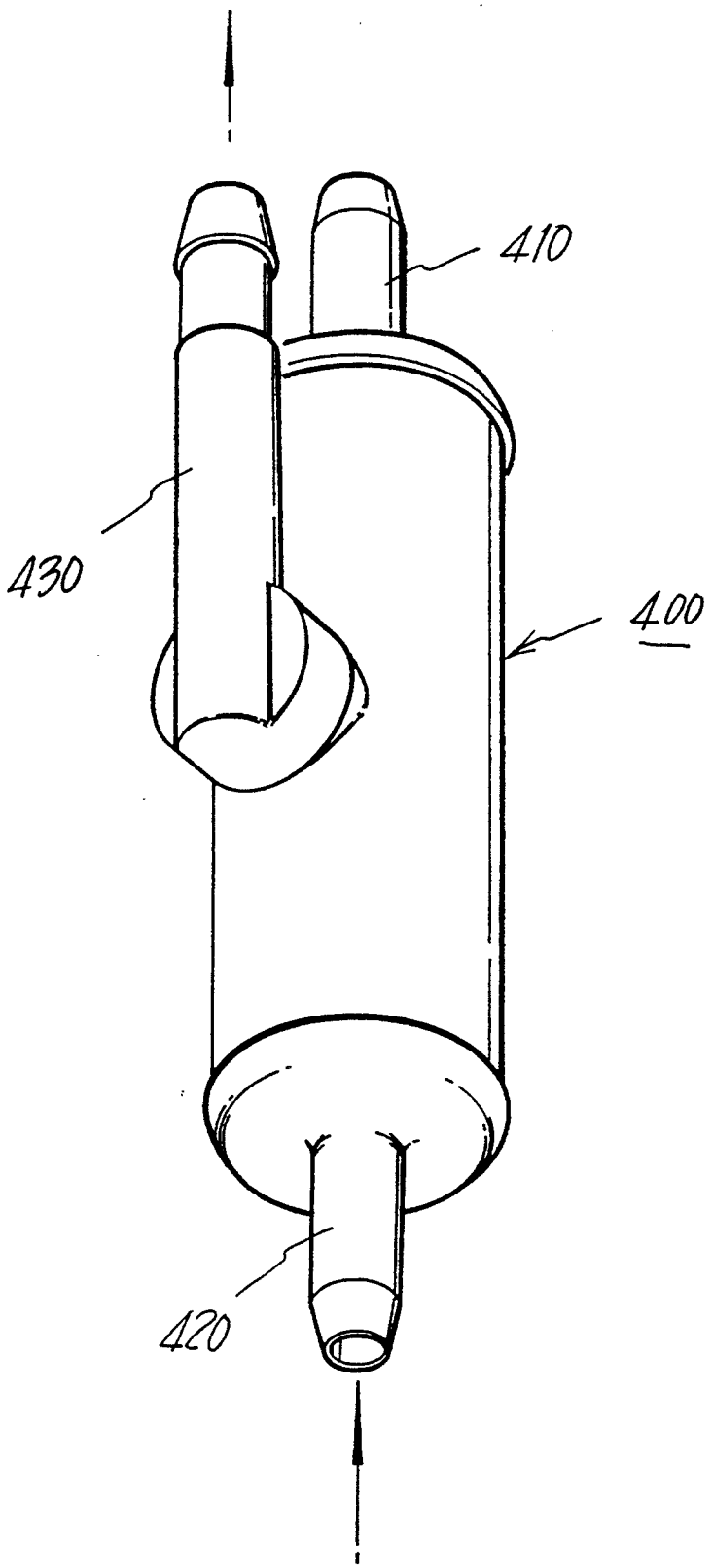
FIG. 2 is a perspective vie of the discharging path open/close shifting valve of the liquid storing container of the present invention, FIGS. 3(A) and (B) are respectively longitudinal cross-sectional views showing a structure of the open/close shifting valve of the present invention, and illustrate the operating states of the open/close shifting valve.

FIG. 2 and FIGS. 3(A) and (B) show details of the structure of the open/close shifting valve 400. The open/close shifting valve 400 has a main body made of substantially hollow cylindrical shape, a first introducing pipe 410, and a second introducing pipe 420 which are respectively separately made and coupled at opposite ends of this main body. Each connecting tube or introducing tube 500 extends close to the bottom surface and the top surface respectively within the storage tank 100 are mounted to the first and second introducing pipes 410, 420 respectively. These connecting tubes 500 are set at upper ant lower sides within the storage tank 100, so that the end of at least one of them is below the contents storing level and facilitates the discharging of the contents irrespective of the position, or change thereof, of the contents stored within the container. Thus, the storage container may stand upright or be inverted and an end of at least one connecting tube will be below the content level.

A sucking pipe 430 is provided, one end of which is coupled to the open/close shifting valve at an appropriate location, at about the middle portion of the main body wall. Another end thereof is adapted to be releasably coupled to the end of the discharging pipe 300.

A common path 401 is defined in which the first and second introducing pipes 410, 420 and the sucking pipe 430 are commonly connected together thereby providing a flow path for the contents. Each opening and closing ball 600 is contacted and released in the common path 401. The first and second introducing pipes 410, 420 each have a seat 700 for the ball for permitting flow or cutting off the discharging of the contents.

Chambers 411, 421 are provided to accommodate the opening/closing balls 600 and permit the balls to freely ascend and descend thus defining a discharging path for the contents. The opening/closing balls 600 provided in each chamber 411, 421 constitute a weight which is smaller than the sucking force produced by the discharging structure 200.

Figure 4:
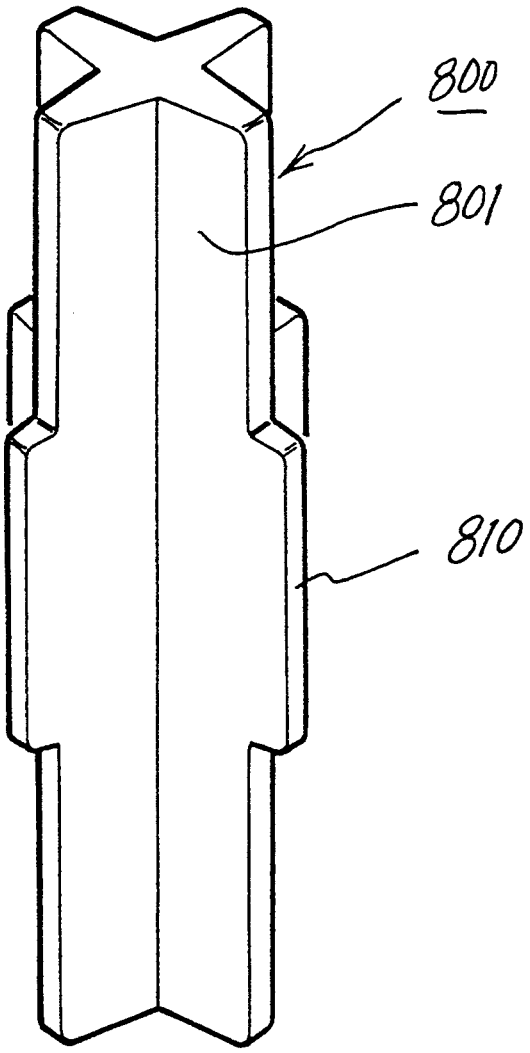
FIG. 4 is a magnified perspective view of a plunger applied to the open/close shifting valve of the present invention.

A plunger 800 having a little longer length than the whole length of the common path 401 is freely movably within the common path 401 defined at the central portion of the open/close shifting valve 400. This plunger 800 has a wider portion 810 which cannot move out of the interior of the common path 401, i.e., which is a little wider at its middle portion so that the plunger 800 can ascend and descend over an appropriate operating distance within the common path and will not be able to escape from the common path. The plunger 800 passes through the seat 700 for opening and closing the first and second introducing pipes, and its main body has a cross shape in section as shown in FIG. 4 so as not to block the path of the seat when the plunger passes the seat. Thus, the flow of contents is possible through the open spatial portions provided in four directions of the main body of the plunger.

The descending operation of the plunger 800 is produced by a selfweighting of any one opening/closing ball 600, which operates in accordance with the position of the storage container, the sucking force operating from the discharging structure and the weight of the plunger itself. The descending of the plunger moves the plunger to a lower portion from an upper portion within the common path, so that the plunger protrudes into the chamber by passing through the seat. In this condition, the upper opening/closing ball shuts the path of the upper seat regardless of the plunger. In other words, the top end of the plunger is positioned at the same level as the path of the seat or located at a little lower position, and the lower opening/closing ball is pushed to the plunger bottom end, released from the lower seat and thereby forms an opening path. Thus, to move the one opening/closing ball to a released position away from the seat by utilizing the plunger correspondingly ensures that the other opening/closing ball is shut thereby maintaining the open path state when a sucking force is generated by the discharging structure.

Figure 3:
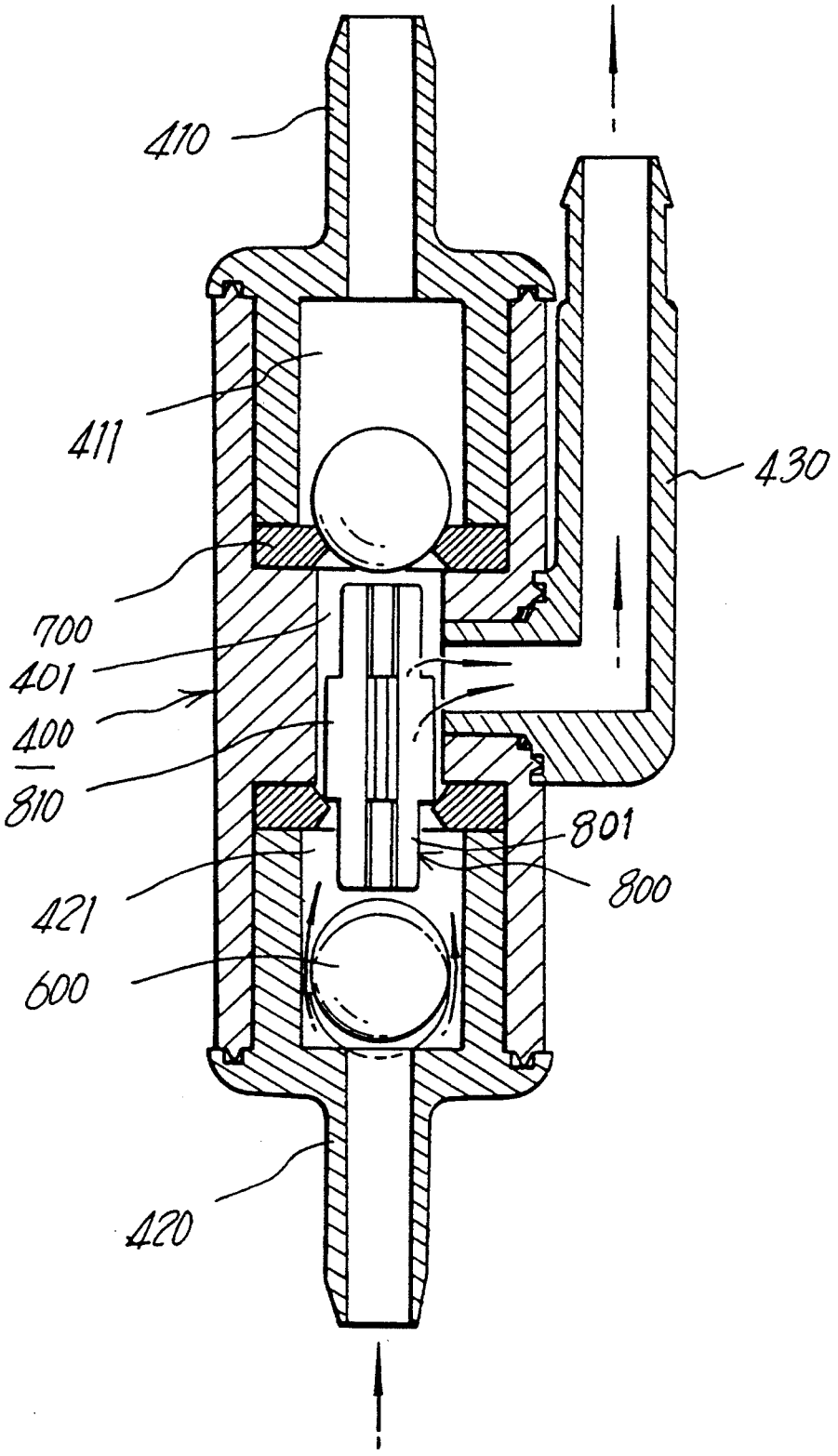
Figure 3:
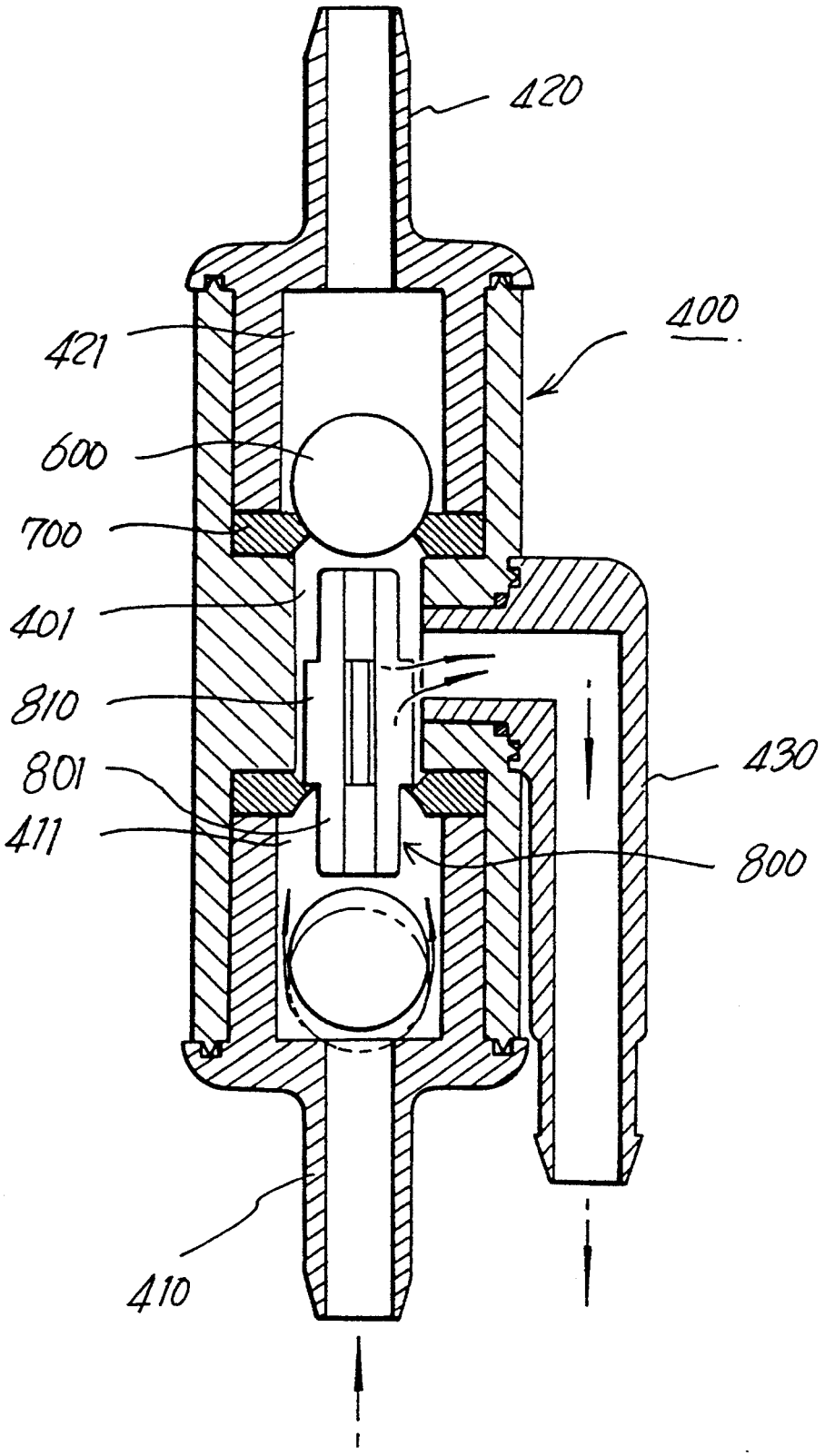

Operation of the open/close shifting valve will be described in more detail with reference to FIGS. 3 (A) and (B). FIG. 3(A) shows an example where the storage container is used by standing upright, and at this time, the opening/closing ball 600 contacts the seat 700 of chamber 411, which supplies the first introducing pipe 410. The path of the first introducing pipe is therefore shut. In the second introducing pipe 420, the plunger 800 within the common path 401 descends so that the seat 700 provided in the chamber 421 which supplies the second introducing pipe 420, provides an open path and the contents normally stored at the bottom within the storage container can be discharged through the second introducing pipe 420 and the suction pipe 430. At this time, the opening/closing ball 600 in the chamber 421 of the second introducing pipe 420 is lifted/supported by the contents sucked by the suction force operating the second introducing pipe and the inlet side of the second introducing pipe is not blocked.

FIG. 3(B) shows an example where the storage container is used inverted. At this time, in contract with the above-described situation, the seat 421 of the second introducing pipe 420 is shut by the opening/closing ball 600 and the first introducing pipe 410 is opened so that the contents which have been stored in top side of the storage container can be discharged.

The present invention is convenient to use because the contents within the storage container can be simply and conveniently discharge in any direction irrespective of whether the storage container stands upright or inverted. Also, the contents can be simply and conveniently fed to a desired place under any conditions, irrespective of location or direction of the storage container.

What is claimed is:

1. A fluid discharge apparatus comprising:

a storage tank for the fluid;

a discharging structure outside the storage tank through which the fluid is discharged;

a discharge valve within the storage tank, the discharge valve having first and second connecting pipes extending therefrom towards opposite ends of the storage tank, the discharge valve including a flow path and the first and second connecting pipes being connected to the flow path, the flow path including first and second ascending and descending closure means so that when the flow path to one of said first and second connecting pipes is open, the flow path to the other of said first and second connecting pipes is closed, the flow path being closed by one of said first and second closure means by gravity urging the one of said first and second closure means into a closed position;

a discharge pipe extending from a position in communication with the flow path of the discharge valve between the first and second closure means to the discharging structure;

a plunger located in the flow path of the discharge valve, the plunger movable within the flow path in response to gravity between a first position to move one of said first and second closure means so that it does not close the flow path, a second position to move the other of said first and second closure means so that it does not close the flow path;

whereby the discharge structure in operation produces a suction force greater than the force of gravity on the first and second closure means and contents of the storage tank man be discharged through the discharge structure when the storage tank is in an upright or inverted position.

2. A discharge apparatus as claimed in claim 1 wherein the first and second closure means are ball valves.

3. A discharge apparatus as claimed in claim 1 wherein the plunger has a shape which is substantially of a cross in cross-section, the plunger having an increased diameter near its mid-portion which acts on fixed means within the flow path to restrict axial movement of the plunger within the flow path.

4. A fluid discharge apparatus comprising:

a storage tank for the fluid;

a discharging structure outside the storage tank through which the fluid is discharged;

a discharge valve within the storage tank, the discharge valve having first and second connecting pipes extending therefrom towards opposite ends of the storage tank, the discharge valve including a flow path and the first and second connecting pipes being connected to the flow path, the flow path including first and second ascending and descending closure means so that when the flow path to one of said first and second connecting pipes is open, the flow path to the other of said first and second connecting pipes is closed, the flow path being closed by one of said first and second closure means by gravity urging the one of said first and second closure means into a closed position;

a discharge pipe extending from a position in communication with the flow path of the discharge valve between the first and second closure means to the discharging structure;

said flow path including a first chamber adjacent the first connecting pipe and a second chamber adjacent the second connecting pipe, said first and second closure means being in the form of ball valves being located within each chamber, and a plunger located in the flow path between the first and second chambers, the plunger being movable in response to gravity to urge one of said first and second closure means into its chamber to open the flow path from that chamber when the storage tank is substantially upright, and to urge the other of said first and second closure means into its chamber to open the flow path from that chamber when the storage tank is in a substantially inverted position;

whereby the discharge structure in operation produces a suction force greater than the force of gravity on the first and second closure means and contents of the storage tank may be discharged through the discharge structure when the storage tank is in an upright or inverted position.

* * * * *